US007497393B2

(12) United States Patent
Abramson et al.

(10) Patent No.: US 7,497,393 B2
(45) **Date of Patent: *Mar. 3, 2009**

(54) SHREDDER HEAD HAVING SHREDDER BLADES AND AN ASSOCIATED SAFETY FEATURE FOR PROTECTING A PORTION OF A PERSON'S BODY

(76) Inventors: Aron Abramson, 2025 E. 9 St., Brooklyn, NY (US) 11223; Charles Sued, 3360 Bedford Ave., Brooklyn, NY (US) 11210

( * ) Notice: Subject to any disclaimer, the term of this patent is extended or adjusted under 35 U.S.C. 154(b) by 33 days.

This patent is subject to a terminal disclaimer.

(21) Appl. No.: 11/379,869

(22) Filed: Apr. 24, 2006

(65) Prior Publication Data

US 2007/0228197 A1 Oct. 4, 2007

Related U.S. Application Data

(63) Continuation-in-part of application No. 11/277,832, filed on Mar. 29, 2006, now Pat. No. 7,303,158.

(51) Int. Cl.
*B02C 25/00* (2006.01)

(52) U.S. Cl. ..... 241/30; 241/36; 241/37.5; 241/100; 241/101.3; 241/236

(58) Field of Classification Search ..... 241/30, 241/36, 37.5, 101.3, 100, 236
See application file for complete search history.

(56) References Cited

U.S. PATENT DOCUMENTS 2,308,578 A 1/1943 White et al.
4,495,456 A 1/1985 Vercillo et al.
4,609,155 A 9/1986 Garnier
4,650,128 A 3/1987 Goldhammer
5,035,366 A 7/1991 Hashimoto et al.
5,054,695 A 10/1991 Koornhof
5,167,374 A 12/1992 Strohmeyer
5,474,241 A 12/1995 Kennedy
5,772,129 A 6/1998 Nishio et al.
5,839,675 A 11/1998 Henreckson et al.
5,934,584 A 8/1999 Schwelling
5,988,542 A 11/1999 Henreckson et al.
6,079,645 A 6/2000 Henreckson et al.
6,116,528 A 9/2000 Schwelling
D437,343 S 2/2001 Ho
D446,543 S 8/2001 Ho
D449,850 S 10/2001 Ho
D454,907 S 3/2002 Ho
D455,170 S 4/2002 Ho
D455,171 S 4/2002 Ho
6,390,397 B1 5/2002 Ko
6,513,740 B2 2/2003 Ho
6,588,616 B1 7/2003 Ho
D498,252 S 11/2004 Lo
D498,253 S 11/2004 Lo
D502,729 S 3/2005 Lo
D502,960 S 3/2005 Lo
D502,961 S 3/2005 Lo
6,964,386 B2 11/2005 Ho (Continued)

*Primary Examiner*—Mark Rosenbaum
(74) *Attorney, Agent, or Firm*—Garcia-Zamor IP Law; Ruy M. Garcia-Zamor

(57) ABSTRACT

A shredder having a safety feature(s) that reduces potential safety hazards by detecting the touch of a portion of a person's body.

20 Claims, 6 Drawing Sheets

U.S. PATENT DOCUMENTS

| | | | | |
|---|---|---|---|---|
| 7,311,276 | B2 * | 12/2007 | Matlin et al. | 241/37.5 |
| 2003/0006330 | A1 | 1/2003 | Chang | |
| 2003/0042342 | A1 | 3/2003 | Kroger et al. | |
| 2004/0129810 | A1 | 7/2004 | Kasprowicz et al. | |
| 2005/0001080 | A1 | 1/2005 | Nemedi | |
| 2005/0236503 | A1 | 10/2005 | Matlin et al. | |
| 2005/0241998 | A1 | 11/2005 | Nemedi | |
| 2007/0012808 | A1 * | 1/2007 | Kao | 241/37.5 |

* cited by examiner

SHREDDER HEAD HAVING SHREDDER BLADES AND AN ASSOCIATED SAFETY FEATURE FOR PROTECTING A PORTION OF A PERSON'S BODY

CROSS REFERENCE TO RELATED APPLICATION

This application is a continuation-in-part of and claims priority to U.S. patent application Ser. No. 11/277,832, filed on Mar. 29, 2006 now U.S. Pat. No. 7,303,158, entitled "Shredder Head Having Shredder Blades and an Associated Safety Feature for Protecting a Portion of a Person's Body", invented by Aron Abramson and Charles Sued, which is hereby incorporated by reference herein as if fully set forth in its entirety.

BACKGROUND

The present invention is generally directed to shredders and, more specifically, to a safety feature(s) for shredders.

Conventional shredders can have three operating modes. The first operating mode is an "off" mode in which the shredder blades are deactivated and no shredding of material can take place. The second operating mode is an "on" mode in which the shredder blades continually rotate to shred any material inserted into the shredder. The third operating mode is an "automatic" mode in which the shredder blades are automatically activated when the shredder detects that material is being inserted into the shredder. The "automatic" mode is advantageous in that material can be sporadically shredded without having to continually turn the shredder on and off. This makes it easy to open mail and immediately shred those items which are unneeded and may contain personal information.

However, the use of shredders in "automatic" mode can be problematic. The shredder can unintentionally be left in "automatic" mode after all shredding is completed since the lack of noise generated from shredder blade movement may result in a user forgetting that the shredder is not off. A shredder left in "automatic" mode for an extended period of time can present a safety hazard to the original or new users who are unaware that the shredder is only waiting to detect the insertion of material therein to activate its shredder blades. This can result in fingers or clothing being positioned near or inside the shredder slot while the shredder is not off which may lead to serious injury. The problem is further exacerbated when little children approach an unmonitored shredder left in "automatic" mode. Children are more prone to insertion of clothing and/or body parts into a shredder slot and are very likely to believe that the shredder is off. The impact of shredder blades on a young child can be devastating.

Safety hazards are also present in those shredders operating in "on" mode. These problems result from the shredder's ability to be left in "on" mode while unattended and also from portions of one's body being inserted in the shredder's material feed slot while the shredder is in the "on" mode. This also creates a hazard to which children are especially susceptible.

One solution to this problem is to provide a control circuit with nodes that are present along the outer surface of the shredder housing that relies on the static charge of a person to be detected by the control circuit through the nodes. When the human charge is detected, the control circuit turns the shredder off. This is problematic for a few reasons. When feeding paper into the shredder, a user's hand frequently briefly contacts enough nodes to cause the shredder to not function reliably. Additionally, when a person's skin is dry and/or the environment is humid, the sensitivity of the control circuit is reduced due to its reliance on detecting the latent static charge in a person. This can result in the control circuit failing to detect a portion of a person's body and allowing the shredder blades to cause serious injury. Additionally, metallic and/or magnetic objects such as credit cards and or metallic decorative inks can result in the shredder accidentally stopping due to mistaking the metallic and/or magnetic material as a human body part.

It would be advantageous to provide a shredder that provides increased safety for users and others that come into contact with the shredder.

SUMMARY

Briefly speaking, one embodiment of the present invention is directed to a shredder head having shredder blades and an associated safety feature for protecting a portion of a person's body. The shredder head includes a shredder head housing defining a slot adapted to receive material to be shredded. The shredder head housing includes a portion that forms first and second opposing walls to define sides of the slot. A plurality of shredder blades are disposed within the shredder head housing and are adapted to shred the material inserted into the slot. A first conductive layer is disposed along at least a portion of the first opposing wall. A second conductive layer is disposed along at least a portion of the second opposing wall and separated from the first conductive layer. A first controller is in communication with the shredder and is adapted to cause the plurality of shredder blades to deactivate. A second controller is in communication with at least one of the first and second conductive layers and with the first controller. When the portion of the person's body touches both the first and second conductive layers the second controller is configured to send a signal to the first controller. When the first controller receives the signal the first controller deactivates the plurality of shredder blades.

In a separate aspect, the present invention is directed to a method of shredding material while reducing the probability of injury to a portion of a person's body. The method includes providing a shredder. The shredder includes a shredder head housing defining a slot adapted to receive material to be shredded. The shredder head housing includes a portion that forms first and second opposing walls that define sides of the slot. A plurality of shredder blades are disposed within the shredder head housing and are adapted to shred the material inserted into the slot. A first conductive layer is disposed along at least a portion of the first opposing wall. The first conductive layer extends between an end of the first opposing wall that is farthest from an outer surface of the shredder head housing and a portion of the outer surface of the shredder head housing. The portion of the first conductive layer that is located along the first opposing wall reduces the probability of the plurality of shredder blades damaging the portion of the person's body inserted in the slot. A second conductive layer is disposed along at least a portion of the second opposing wall and is separated from the first conductive layer. The second conductive layer extends between an end of the second opposing wall that is farthest from an outer surface of the shredder head housing and a portion of the outer surface of the shredder head housing. The portion of the second conductive layer that is located along the first opposing wall reduces the probability of the plurality of shredder blades damaging the portion of the person's body inserted in the slot. The method includes: monitoring at least one of the first and second conductive layers to determine when the portion of the person's body touches both the first and second conductive layers;

stopping the activation of the plurality of shredder blades while the first and second conductive layers are both contacted by the portion of the person's body; activating a warning light while the first and second conductive layers are both contacted by the portion of the person's body; and emitting a warning sound while the first and second conductive layers are both contacted by the portion of the person's body.

In a separate aspect, the present invention is directed to a shredder head having shredder blades and an associated safety feature for protecting a portion of a person's body. The shredder head includes a shredder head housing defining a slot adapted to receive material to be shredded. The shredder head housing includes a portion that extends generally inwardly from an outer surface of the shredder head housing to form first and second opposing walls to define sides of the slot. The first and second opposing walls each have a distal end located opposite from the outer surface. A plurality of shredder blades are disposed within the shredder head housing and are adapted to shred the material inserted into the slot. A first conductive layer is disposed along at least a portion of the first opposing wall. At least a portion of the first conductive layer is located proximate to the distal end of the first opposing wall. A second conductive layer is disposed along at least a portion of the second opposing wall and is separated from the first conductive layer. At least a portion of the second conductive layer is located proximate to the distal end of the second opposing wall. A controller is in communication with the shredder and is adapted to cause the plurality of shredder blades to deactivate while the portion of the person's body touches both the first and second conductive layers.

In a separate aspect, the present invention is directed to a method of shredding material while reducing the probability of injury to a portion of a person's body. The method includes providing a shredder. The shredder includes a shredder head housing that defines a slot. A plurality of shredder blades are disposed within the shredder head housing and are adapted to shred the material inserted into the slot. A first conductive layer is disposed along at least a portion of the outer surface of the shredder housing and along a portion of the shredder within the slot. A second conductive layer is disposed along at least a portion of the outer surface of the shredder housing and along a portion of the shredder within the slot. The second conductive layer is separated from the first conductive layer. The method also includes: monitoring at least one of the first and second conductive layers to determine when the portion of the person's body touches both the first and second conductive layers by detecting a change in electrical properties of circuitry attached to at least one of the first and second conductive layers caused by the capacitance of the portion of the person's body; and stopping the activation of the plurality of shredder blades while the first and second conductive layers are both contacted by the portion of the person's body.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENTS

Figure 1:
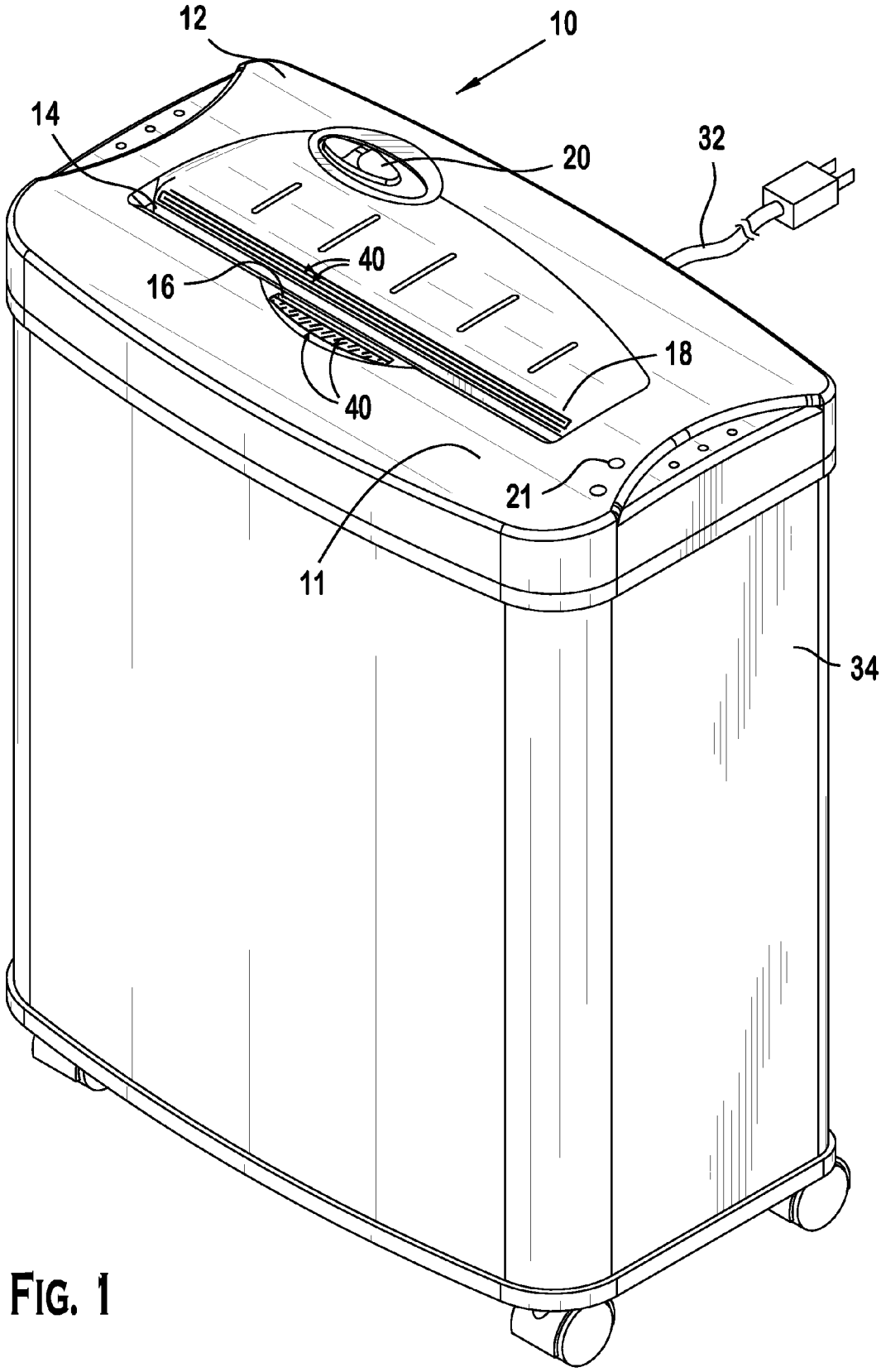
FIG. 1 is a perspective view of a shredder according to a preferred embodiment of the present invention.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the shredder and designated parts thereof. The term "controller", as used in the claims and the corresponding portions of the specification, means "any one of a circuit, an integrated circuit, a printed circuit board, or the like". The term "selectable control", as used in portions of the specification, means "any one of a physical switch, a touch switch, a button, a voice activated switch, a control knob, a remote control switch, or any other known operating mode selection device". The term "activated state", as used with lights and/or speakers, means that the light and/or speaker has been manipulated to emit light and/or sound, respectively. The term "activated" as used with shredder blades means that the blades are moved in whatever manner results in shredding (i.e., that the blades 18 are operating for shredding). Thus, the term "activated" means that the blades are normally operational as per their designed operation for shredding as is the case when a shredder is left in the "on" mode. The language "at least one of 'A', 'B', and 'C'," as used in the claims and in corresponding portions of the specification, means "any group having at least one 'A'; or any group having at least one 'B'; or any group having at least one 'C';—and does require that a group have at least one of each of 'A', 'B', and 'C'." Additionally, the words "a" and "one" are defined as including one or more of the referenced item unless specifically stated otherwise. The terminology includes the words above specifically mentioned, derivatives thereof, and words of similar import.

Referring to FIGS. 1-8, wherein like numerals indicate like elements throughout, there are shown preferred embodiments of a shredder 10 having a safety feature according to the present invention. Briefly speaking, the shredder 10 senses when a portion of a person's body 96 comes into contact with the shredder head at a location proximate to and/or inside a slot 14, 16. When a portion of a person's body 96 is detected, the shredder 10 stops the activation of the shredder blades.

Figure 5:
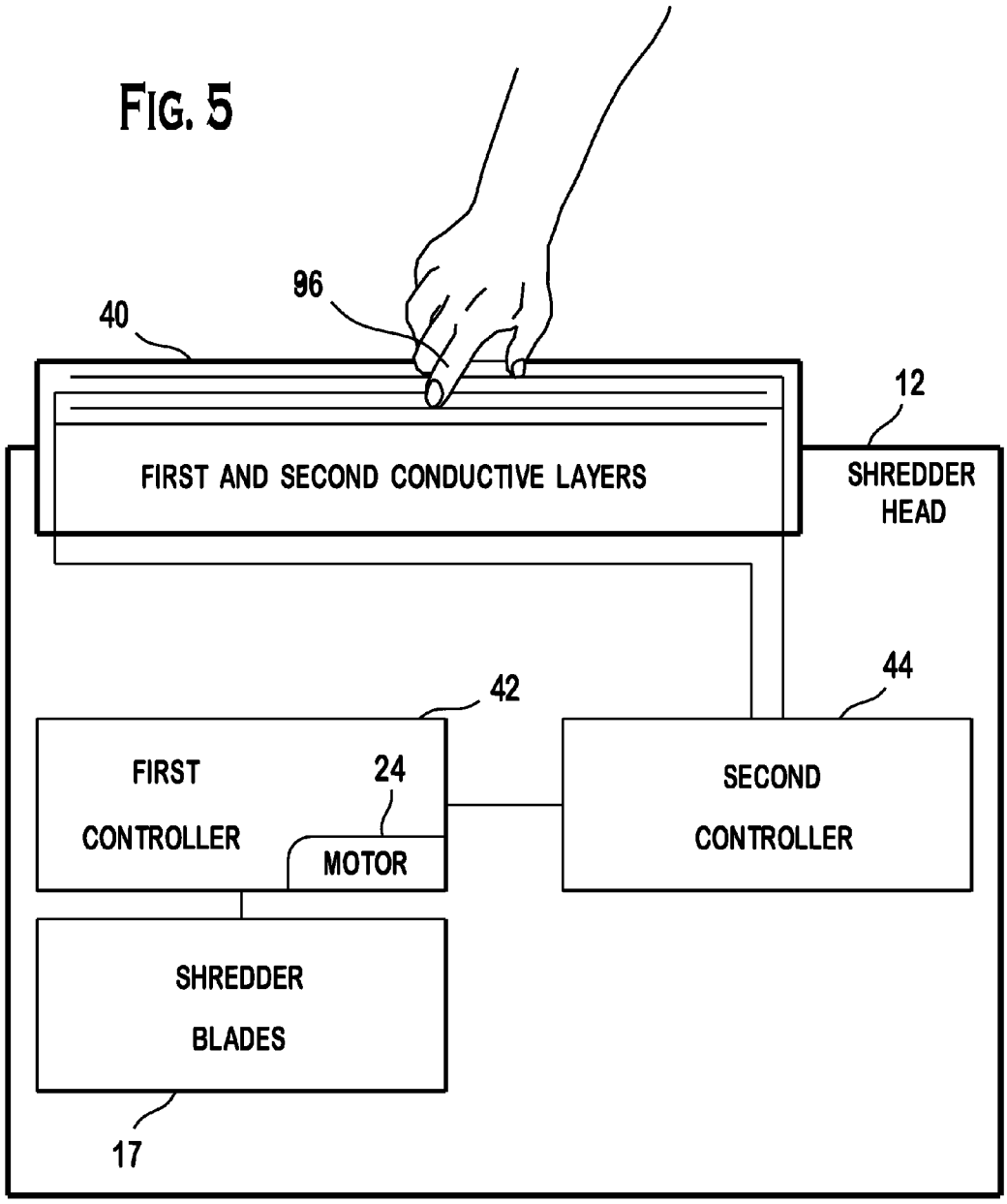
FIG. 5 is a block diagram of the shredder head of FIG. 1.
Figure 7:
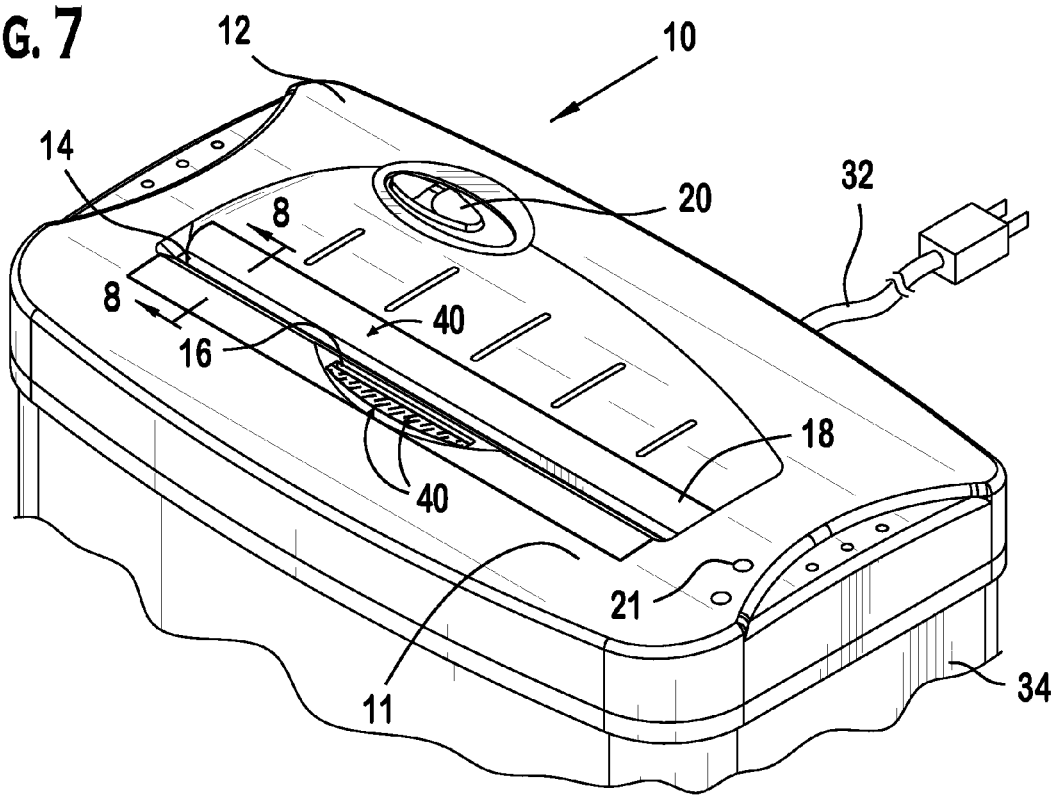
FIG. 7 is a perspective view of a shredder according to a second preferred embodiment of the present invention, the shredder preferably uses the controller shown in FIG. 6.

Referring to FIGS. 1, 5, and 7, one embodiment of the present invention includes a shredder with a shredder head housing 12. The shredder head housing 12 defines at least one slot 14, 16 for inserting material to be shredded. The primary slot 14 guides material to be shredded to shredder blades 17 that are driven by a motor 24 located in the shredder head housing 12. The plurality of shredder blades 18 are disposed within the shredder head housing 12 and are adapted to shred material inserted into one of the slots 14, 16. The first slot 14 is preferably used for paper documents and the second slot 16 is preferably used for more rigid documents, such as credit cards, compact discs, etc.

Referring to FIG. 1, while the preferred shredder head housing 12 has a generally rectilinear shape, those of ordinary skill in the art will appreciate from this disclosure that the shredder head housing 12 can have any shape without departing from the scope of the present invention. The shredder head may also include a bin full indicator or other operational indicators. Shredder head handles are preferably, but not necessarily, located on the left and right lateral sides of the shredder head housing 12 to allow easy lifting of the shredder head from the shredder basket 34.

The shredder preferably receives power from an outlet via a power conduit, such as an electrical cord, 32. However, the shredder can be powered by batteries or any other suitable power source.

Figure 3:
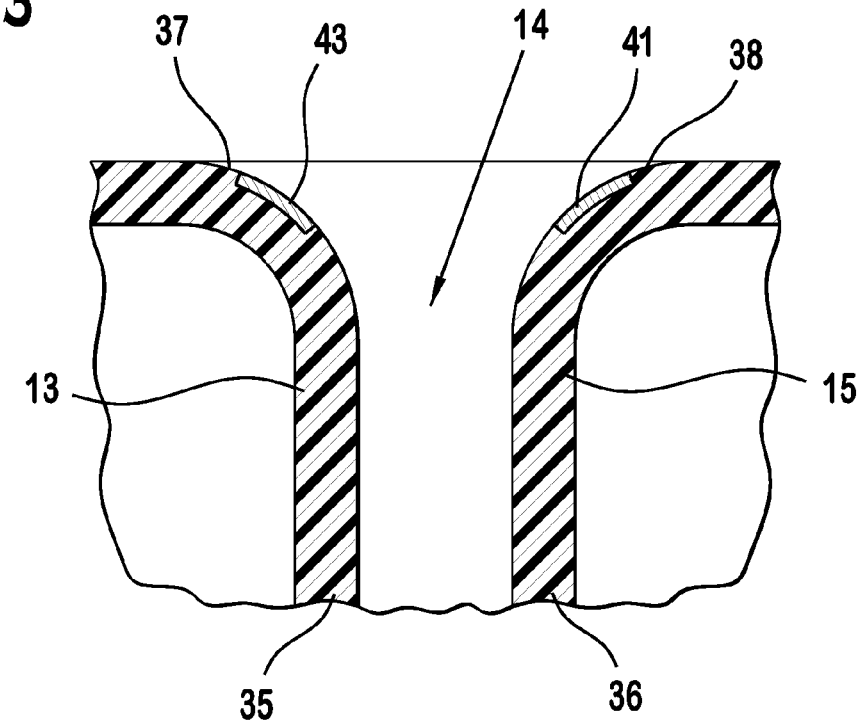
FIG. 3 is a broken away cross sectional view of the slot of the shredder of FIG. 1 showing a portion of the opposing walls that form sides of the slot through which material can be fed into the shredder head for shredding.
Figure 4:
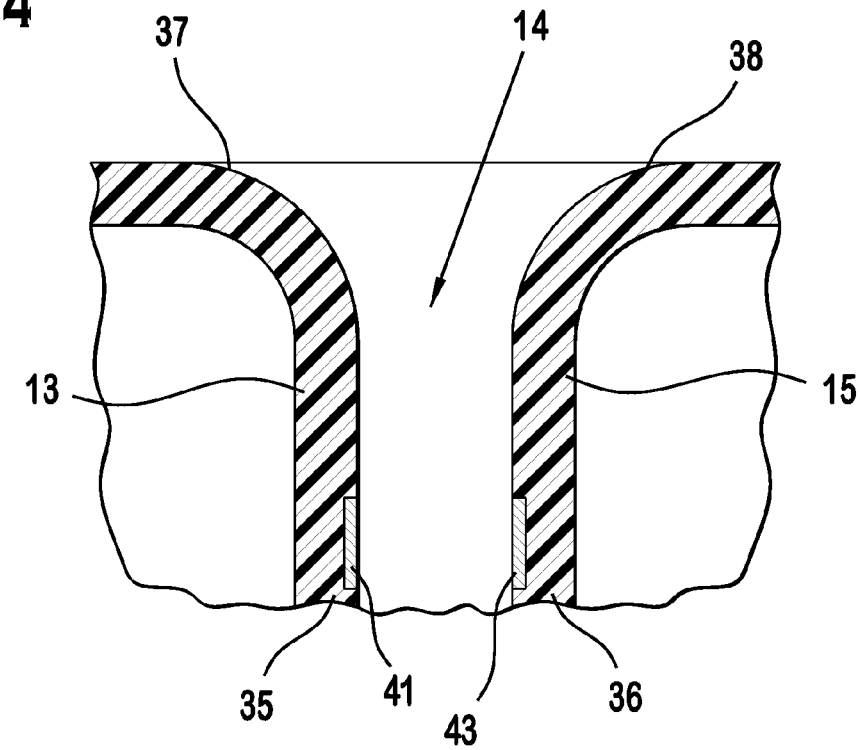
FIG. 4 is a second broken away cross sectional view of the slot of the shredder of FIG. 1 showing a portion of the opposing walls.
Figure 8:
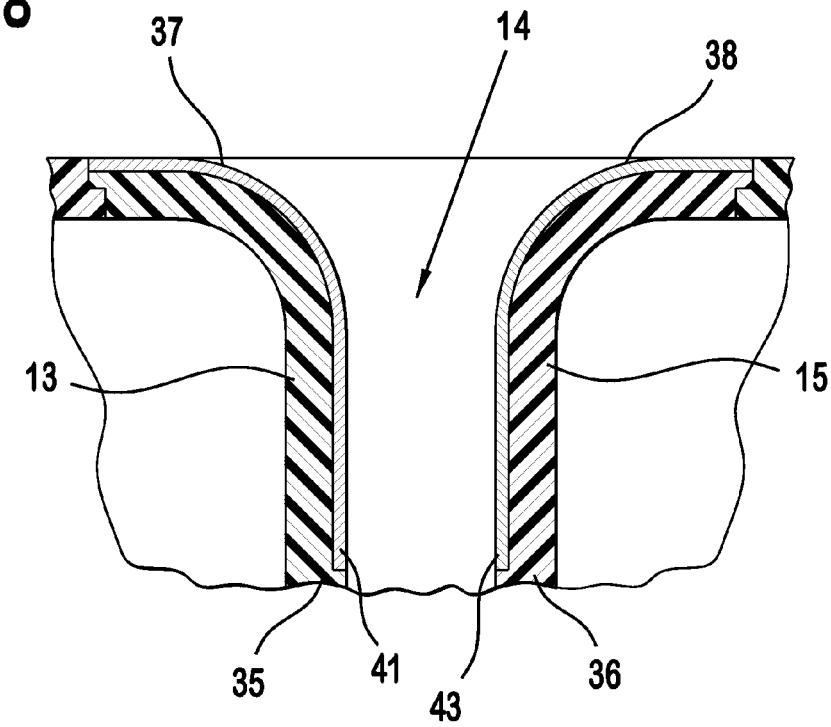
FIG. 8 is a broken away cross sectional view of the slot of the shredder of FIG. 7 illustrating a first conductive layer disposed substantially over an entire opposing wall and a second conductive layer disposed substantially over the other opposing wall, the first and second conductive layers preferably also extend along a portion of the upper outer surface of the shredder head housing.

Referring to FIGS. 1 5, and 8, the shredder 10 includes a shredder head housing 12 defining at least one slot 14, 16 adapted to receive material to be shredded. Referring to FIGS. 1, 3, and 4, the shredder head housing 12 may include a portion 18 that forms first and second opposing walls 13, 15 to define sides of the slot 14, 16.

Figure 2:
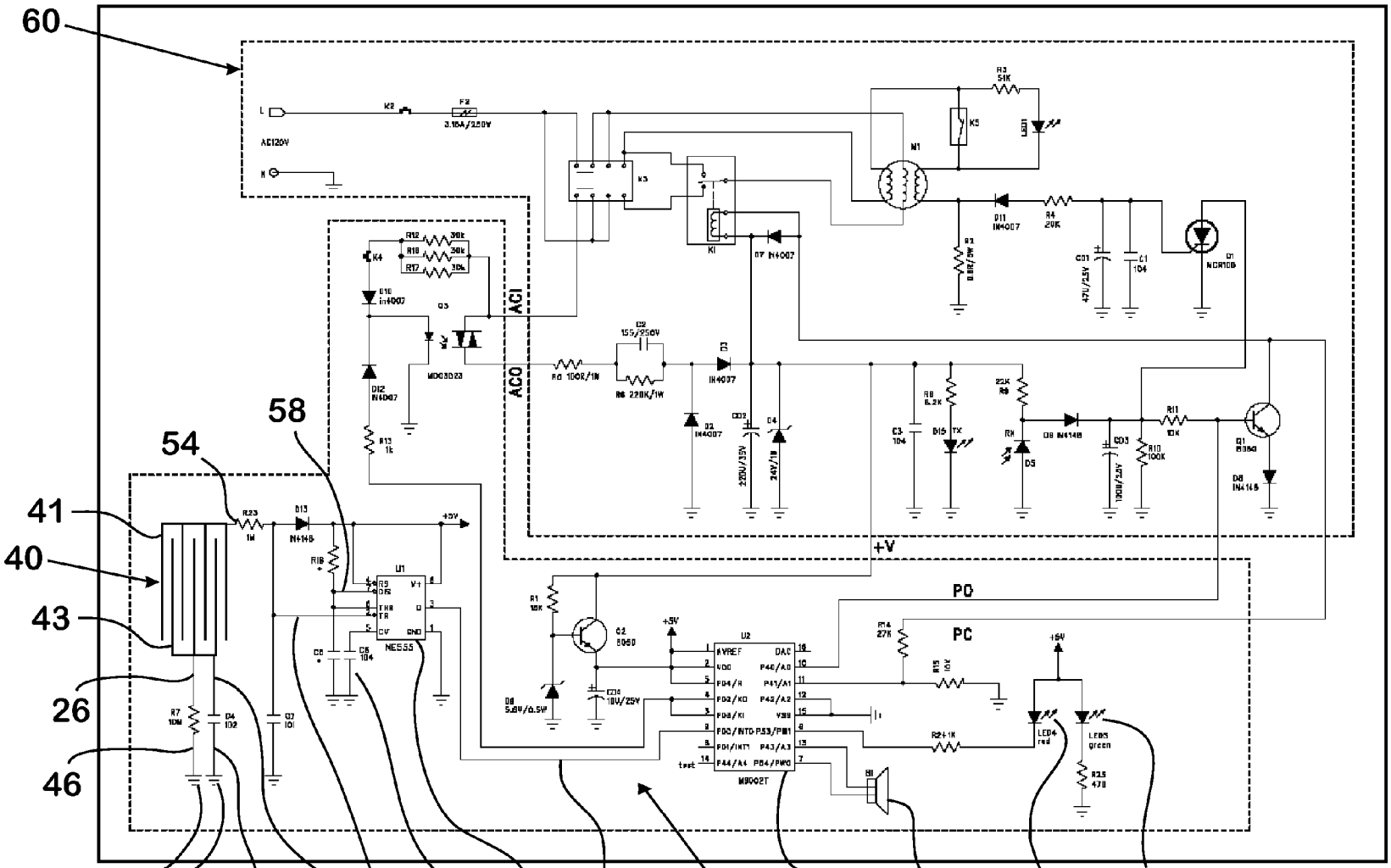
FIG. 2 is a circuit diagram of a preferred controller of the shredder of FIG. 1.
Figure 6:
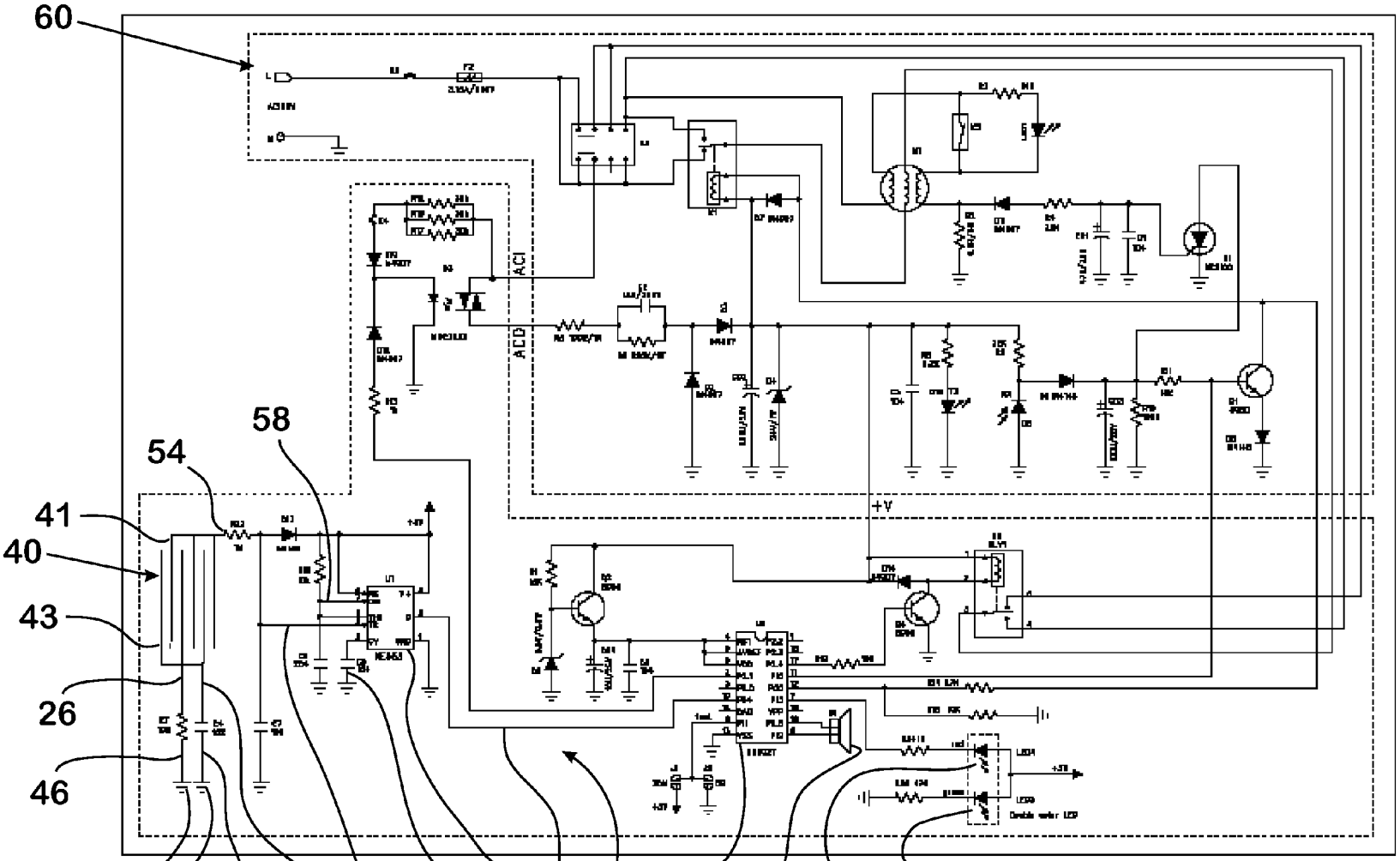
FIG. 6 is a circuit diagram of a second preferred controller for a shredder.

Referring to FIGS. 2, 5, and 6, touch detection circuitry 70 and shredder control circuitry 60 is preferably disposed at least partially within the shredder head housing 12. When the shredder is in "automatic" mode and detects inserted material, at least one of the touch detection circuitry and the shredder control circuitry activates the plurality of shredder blades 17 to shred the detected material. It is preferred, that the shredder blades 17 rotate upon activation. However, vibratory movement, reciprocating movement, or any other suitable shredding movement can be used when the shredding blades 18 are activated.

The shredder 10 may include a motor 24 disposed in the shredder head housing 12 and adapted to drive the plurality of shredder blades 17. The motor 22 may be considered separate from the first and second controllers 42, 44 or can be integrated therewith without departing from the scope of the present invention. The first and second controllers 42, 44 may include one or more sensors, such as an electronic eye, disposed within the shredder head housing 12 and adapted to detect the material inserted into a slot 14, 16. The electronic eye is preferably, but not necessarily, formed by a diode pair comprising a light emitting diode and a light detecting diode. However, those of ordinary skill in the art will appreciate from this disclosure that any type of sensor(s) can be used to detect the insertion of material to be shredded without departing from the scope of the present invention.

Referring to FIGS. 1, 2, 5, and 8, the shredder 10 includes a first conductive layer 41 disposed on at least a portion of the outer surface 11 of the shredder head housing. Referring to FIGS. 3 and 4, it is preferable that the first conductive layer 41 is disposed on at least a portion of the opposing walls 13, 15. Referring specifically to FIG. 4, when the first conductive layer 41 is positioned on at least a portion of the opposing walls, the first conductive layer 41 is preferably located proximate to a distal end 35, 36 of the opposing walls 13, 15. Alternatively, the first conductive layer 41 can be located proximate ends 37, 38 of the opposing walls 13, 15 that are proximate to the outer surface 11 of the shredder head housing. Referring to FIG. 8, the first and second conductive layers 41, 43 can be positioned such that the first conductive layer 41 extends between an end 35 of the first opposing wall 13 that is farthest from an outer surface of the shredder head housing 12 and a portion of the outer surface of the shredder head housing 12 and the second conductive layer 43 extends between an end 36 of the second opposing wall 15 that is farthest from an outer surface of the shredder head housing 12 and a portion of the outer surface of the shredder head housing 12. Alternatively, the first and second conductive layers 41, 43 can be located entirely on at least one of the first and second opposing walls 13, 15 to configure the shredder 10 to operate normally regardless of whether the outside of the shredder head housing 12 is contacted by the portion of the person's body.

Referring to FIGS. 1, 2, and 5, the shredder 10 includes a second conductive layer 43 disposed on at least a portion of the outer surface 11 of the shredder head housing. Referring to FIGS. 3 and 4, it is preferable that the second conductive layer 43 is disposed on at least a portion of the opposing walls 13, 15. Referring specifically to FIG. 4, when the second conductive layer 43 is positioned on at least a portion of the opposing walls, the second conductive layer 43 is preferably located proximate to a distal end 35, 36 of the opposing walls 13, 15. Alternatively, the second conductive layer 43 can be located proximate ends 37, 38 of the opposing walls 13, 15 that are proximate to the outer surface 11 of the shredder head housing. It is preferred that the second conductive layer 43 is separated from the first conductive layer 41. However, those of ordinary skill in the art will appreciate from this disclosure that the locations of the first and second conductive layers 41, 43 can be varied in location or area without departing from the scope of the present invention.

Referring specifically to FIG. 2, it is preferred that the first and second conductive layers 41, 43 are interspaced in a fingered format so that both the first and second conductive layers 41, 43 can be contacted by a single finger touching just one side of a slot 14, 16 or one area of the shredder head 12. Referring to FIGS. 3 and 4, as an alternative, the first and second conductive layers can be on separate sides of the opposing walls 13, 15 without departing from the scope of the present invention. This would require a person to contact both sides of the slot 14, 16 to stop the shredder. The shredder 10 can also be configured to allow a user to selectively activate the fingers of the first and second conductive layers 41, 43 so that they can either be intermeshed in one area or located in separate areas. By selecting how to activate the conductive layers 41, 43, a user can alter the sensitivity of the shredder 10 and how quickly it will deactivate the shredder blades 17.

Referring to FIGS. 3, 4, 6 and 8, the first and second conductive layers 41, 43 can be separately positioned on the shredder head housing or along the first and second opposing walls 13, 15. When the first and second conductive layers 41, 43 are each located on a separate opposing wall and not interspaced in a fingered format, then a user must touch both of the opposing walls simultaneously to deactivate the shredder blades.

The first and second conductive layers 41, 43 are preferably only as thick as necessary for reliable electrical communication. However, those of ordinary skill in the art will appreciate from this disclosure that the conductive layers 41, 43 can be of any thickness or can extend through the entire thickness of the shredder head housing without departing from the scope of the present invention.

Referring to FIGS. 2 and 6, while first and second controllers 42, 44 are described below, those of ordinary skill in the art will appreciate from this disclosure that a single controller be used to operate the shredder 10 of the present invention without departing from the scope of the present invention. Referring to FIGS. 2 and 5, a first controller 44 is preferably formed by an integrated circuit or any other suitable control mechanism. The first controller 44 is in communication with the shredder 10 and adapted to cause the shredder blades 17 to deactivate when certain conditions are met.

A second controller 42 is preferably in communication with at least one of the first and second conductive layers 41, 43. When a portion of a person's body 96 touches both the first and second conductive layers 41, 43, the second controller 42 is adapted to send a signal to the first controller 44. When the first controller 44 receives the signal, the first controller 44 deactivates the shredder blades 17. The second controller can preferably differentiate between the capacitance of a human and when a metallic and/or magnetic object contacts both of the first and second conductive layers 41, 43. This prevents credit cards, and metallic decorative inks from being misinterpreted as a human body part.

Referring still to FIGS. 2 and 6, the illustrated schematic is exemplary only. Those of ordinary skill in the art will appreciate from this disclosure that any suitable circuit(s) can be used without departing from the scope of the present invention. In the preferred circuitry, when shredding material and when a portion of the person's body 96 is in contact with both the interspaced first and second conductive layers 40, the condition of the conductive layers 41, 43 is constant. During this time, the second controller's 42 second pin is activated in a high electric level (bigger then ⅔ Voltage Drain Drain). The second controller 42 sends a signal via the second controller's third pin 52 output to the first controller 44. The signal can be a high, low, or a zero voltage signal as desired. The first controller 44 maintains the shredder 10 in normal operating condition while receiving the appropriate signal from the second controller 42.

During shredder operations, when a portion of a person's body 96 touches both the conductive layers 41, 43, the capacitance of the person's body 96 is connected with a high resistance resistor 46. This results in an interference signal detected capacitor 48 and resistor 46. Since, at the moment conductive layers 41, 43 are touched, the second pin of the second controller 42 has a high input resistance, human capacitance, resistor 46, and resistor 54 are linked through the conductions layers 41, 43 and the person's body which divides the voltage. A touch-off voltage is then filtered by capacitor 48. This results in a very low voltage level being provided to the second pin of the second controller 42. This causes the second controller 42 to send a signal to the first controller 44 which causes the first controller 44 to shut down (i.e., stop the rotation of or otherwise deactivate) the shredder blades 17.

The second controller 42 is preferably an integrated circuit that is in communication with the first conductive layer 41. The second conductive layer 43 preferably has first and second electrical pathways 26, 28 each leading to a ground 30. The first electrical pathway 26 includes a resistor 46 and the second electrical pathway 28 includes a capacitor 48. It is understood that any suitable circuitry can be used with the shredder of the present invention without departing from the scope of the present invention.

The first and second controllers 44, 42 are preferably configured to deactivate the shredder blades 17 until the portion of the person's body 96 stops contacting both the first and second conductive layers 41, 43. Referring to FIG. 1, a warning light 21 is preferably located on an outer surface 11 of the shredder head housing. The first controller 44 preferably activates the warning light 21 while the portion of the person's body 96 touches both of the first and second conductive layers 41, 43. Referring to FIG. 2, the warning light preferably includes multiple light emitting diodes 62, 64 that each emit a different color light. It is preferred that the diodes 62, 64 combine to cause the warning light 21 to emit a generally yellow light when activated. The shredder head preferably also includes a speaker 57 electrically connected to the first controller 44. The first controller 44 activates the speaker 57 to emit a warning sound when the portion of the person's body 96 contacts the first and second conductive layers 41, 43. When contact between a person's body 96 and the conductive layers 41, 43 is brief, then the shredder 10 can be stopped for a brief period such as three seconds while an alarm and warning light are activated. The length of the pause in the shredder 10 operation can be varied as desired.

It is preferable that if the portion of the person's body stays in contact with both the first and second conductive layers 41, 43 for a predetermined amount of time, that the first controller 44 is configured to turn off the shredder head. It is preferred that the predetermined amount of time is less than or equal to thirty seconds. It is more preferable still that the predetermined amount of time is less than or equal to 3 seconds.

The present invention also includes methods of shredding material. The steps of the method need not be performed in the recited order. The methods of the present invention preferably use the shredder 10 described above. However, the methods of the present invention may operate with shredders having fewer or different components from those described above.

Referring to FIGS. 3 and 5, a preferred method of the present invention includes providing a shredder having first and second conductive layers 41, 43. At least one of the first and second conductive layers 41, 43 is monitored to determine when a portion of the person's body 96 touches both the first and second conductive layers 41, 43 by detecting a change in electrical properties of circuitry 60, 70 attached to at least one of the first and second conductive layers 41, 43 caused by the capacitance of the portion of the person's body. The activation of the plurality of shredder blades 17 is stopped while the first and second conductive layers 41, 43 are both contacted by the portion of the person's body 96.

It is preferable that a warning light 21 is activated while the first and second conductive layers 41, 43 are both contacted by a portion of the person's body 96. It is also preferable that a speaker 57 is activated while the first and second conductive layers 41, 43 are both contacted by a portion of the person's body 96.

It is preferable that the power to the shredder is turned off if the first and second conductive layers 41, 43 are contacted for a predetermined period of time which can be set to vary from between thirty minutes to three seconds or less. It is also preferred that a controller is provided as part of the shredder head 10 that detects a change in voltage due to a capacitance change in circuitry 60, 70 resulting from the capacitance of the portion of the person's body 96 while the first and second conductive layers 41, 43 are both contacted by the person's body.

It is recognized by those skilled in the art that changes may be made to the above described methods and/or shredder 10 without departing from the broad inventive concept thereof. It is understood, therefore, that this invention is not limited to the particular embodiments disclosed, but is intended cover all modifications which are within the spirit and scope of the invention as defined by the above specification, the appended claims and/or shown in the attached drawings.

What is claimed is:

1. A shredder head having shredder blades and an associated safety feature for protecting a portion of a person's body, comprising:

a shredder head housing having an outside surface and defining a slot adapted to receive material to be shredded, the shredder head housing including a portion that forms first and second opposing walls to define sides of the slot;

a plurality of shredder blades disposed within the shredder head housing and adapted to shred the material inserted into the slot;

a first conductive layer disposed along at least a portion of the first opposing wall;

a second conductive layer disposed on the shredder head housing and separated from the first conductive layer, wherein the first and second conductive layers are located within the slot such that the portion of the person's body can touch any portion of the outside surface of the shredder housing without contacting either of the first and second conductive layers;

a first controller in communication with the shredder and adapted to cause the plurality of shredder blades to deactivate; and a second controller in communication with at least one of the first and second conductive layers and with the first controller, the second controller being adapted to discriminate between contact with the portion of the person's body and metallic and magnetic objects, wherein when the portion of the person's body touches both the first and second conductive layers the second controller is configured to send a signal to the first controller, when the first controller receives the signal the first controller deactivates the plurality of shredder blades, wherein the shredder is configured such that the plurality of shredder blades are not deactivated when only one of the first and second conductive layers is touched by a portion of the person's body.

2. The shredder of claim 1, wherein the second controller is an integrated circuit in communication with the first conductive layer, the second conductive layer having first and second electrical pathways each leading to a ground, the first electrical pathway including a resistor and the second electrical pathway including a capacitor.

3. The shredder head of claim 1, wherein the first and second controllers are configured to stop the activation of the plurality of shredder blades until the portion of the person's body stops contacting both the first and second conductive layers.

4. The shredder head of claim 1, further comprising a warning light disposed on an outer surface of the shredder head housing, the first controller activating the warning light while the portion of the person's body is touching both of the first and second conductive layers.

5. The shredder head of claim 4, further comprising a speaker electrically connected to the first controller, wherein the first controller activates the speaker to emit a warning sound when the portion of a person's body touches both of the first and second conductive layers.

6. The shredder head of claim 4, wherein the warning light is formed by multiple light emitting diodes each emitting a different color of light.

7. The shredder head of claim 6, wherein the multiple light emitting diodes cause the warning light to emit a generally yellow light when activated.

8. The shredder head of claim 1, wherein the first controller is configured to turn off the shredder head if the portion of the person's body touches the first and second conductive layers for a predetermined amount of time.

9. The shredder head of claim 8, wherein the predetermined amount of time is less than or equal to three seconds.

10. The shredder head of claim 1, wherein the first conductive layer extends between an end of the first opposing wall that is farthest from an outer surface of the shredder head housing and a portion of the outer surface of the shredder head housing and the second conductive layer extends between an end of the second opposing wall that is farthest from an outer surface of the shredder head housing and a portion of the outer surface of the shredder head housing.

11. The shredder head of claim 1, wherein the first and second conductive layers are located proximate to an outer surface of the shredder head housing.

12. A method of shredding material while reducing the probability of injury to a portion of a person's body, comprising:

providing a shredder comprising:

a shredder head housing defining a slot adapted to receive material to be shredded, the shredder head housing including a portion that forms first and second opposing walls that define sides of the slot;

a plurality of shredder blades disposed within the shredder head housing and adapted to shred the material inserted into the slot;

a first conductive layer disposed along at least a portion of the first opposing wall, the first conductive layer extending between an end of the first opposing wall that is farthest from an outer surface of the shredder head housing and a portion of the outer surface of the shredder head housing, the portion of the first conductive layer that located along the first opposing wall reduces the probability of the plurality of shredder blades damaging a portion of a person's body inserted in the slot;

a second conductive layer disposed along at least a portion of the second opposing wall and separated from the first conductive layer, the second conductive layer extending between an end of the second opposing wall that is farthest from an outer surface of the shredder head housing and a portion of the outer surface of the shredder head housing, the portion of the second conductive layer that located along the first opposing wall reduces the probability of the plurality of shredder blades damaging a portion of a person's body inserted in the slot;

monitoring at least one of the first and second conductive layers to determine when the portion of the person's body touches both the first and second conductive layers;

stopping the activation of the plurality of shredder blades while the first and second conductive layers are both contacted by the portion of the person's body, wherein the shredder is configured such that the plurality of shredder blades are not deactivated when only one of the first and second conductive layers is touched by a portion of the person's body;

activating a warning light while the first and second conductive layers are both contacted by the portion of the person's body; and emitting a warning sound while the first and second conductive layers are both contacted by the portion of the person's body.

13. The method of claim 12, wherein the step of monitoring includes providing a first controller in communication with the shredder and adapted to cause the plurality of shredder blades to deactivate; and providing a second controller in communication with the first and second conductive layers and with the first controller.

14. The method of clam 12, further comprising turning off the power to the shredder if the first and second conductive layers are both contacted by the portion of the person's body for a predetermined period of time.

15. The method of claim 12, wherein the step of stopping further includes providing a controller that detects a change in voltage due to a capacitance change in circuitry resulting from the capacitance of the portion of the person's body while the first and second conductive layers are both contacted by the portion of the person's body.

16. A shredder head having shredder blades and an associated safety feature for protecting a portion of a person's body, comprising:

a shredder head housing defining a slot comprising first and second opposing walls each having a distal end;

a plurality of shredder blades disposed within the shredder head housing and adapted to shred the material inserted into the slot;

a first conductive layer disposed along at least a portion of the first opposing wall, at least a portion of the first conductive layer being located proximate to the distal end of the first opposing wall;

a second conductive layer disposed along at least a portion of the second opposing wall and separated from the first conductive layer, at least a portion of the second conductive layer being located proximate to the distal end of the second opposing wall;

a controller in communication with the shredder and adapted to cause the plurality of shredder blades to deactivate while the portion of the person's body touches both the first and second conductive layers, wherein the shredder is comfigured such that the plurality of shredder blades are not deactivated when only one of the first and second conductive layers is touched by a portion of the person's body.

17. The shredder head of claim 16, wherein the first conductive layer extends between an end of the first opposing wall that is farthest from an outer surface of the shredder head housing and a portion of the outer surface of the shredder head housing and the second conductive layer extends between an end of the second opposing wall that is farthest from an outer surface of the shredder head housing and a portion of the outer surface of the shredder head housing.

18. The shredder head of claim 16, wherein the first and second conductive layers are located entirely on at least one of the first and second opposing walls to configure the shredder to operate normally regardless of whether the outside of the shredder head housing is contacted by the portion of the person's body.

19. A method of shredding material while reducing the probability of injury to a portion of a person's body, comprising:

providing a shredder comprising:

a shredder head housing defines a slot;

a plurality of shredder blades disposed within the shredder head housing and adapted to shred the material inserted into the slot;

a first conductive layer disposed on the shredder head housing;

a second conductive layer disposed on the shredder housing, the second conductive layer being separated from the first conductive layer;

monitoring at least one of the first and second conductive layers to determine when the portion of the person's body touches both the first and second conductive layers by detecting a change in electrical properties of circuitry attached to at least one of the first and second conductive layers caused by the capacitance of the portion of the person's body; and stopping the activation of the plurality of shredder blades while the first and second conductive layers are both contacted by the portion of the person's body, wherein the shredder is configured such that the plurality of shredder blades are not deactivated when only one of the first and second conductive layers is touched by a portion of the person's body.

20. The method of claim 19, wherein the step of providing a shredder further comprises the first conductive layer extends between an end of the first opposing wall that is farthest from an outer surface of the shredder head housing and a portion of the outer surface of the shredder head housing and the second conductive layer extends between an end of the second opposing wall that is farthest from an outer surface of the shredder head housing and a portion of the outer surface of the shredder head housing.

* * * * *